106-98 AU 115 EX
6/13/78 XR 4,094,939

United States Patent [19]
Rowlands

[11] 4,094,939
[45] June 13, 1978

[54] METHOD OF REPAIRING ADOBE MASONRY

[75] Inventor: Robert J. Rowlands, #20 3940 N. Romero Rd., Tucson, Ariz. 85705

[73] Assignees: Robert J. Rowlands and Letha B. Rowlands, as JTWTROS, Tucson, Ariz.

[21] Appl. No.: 658,690

[22] Filed: Jun. 30, 1976

[51] Int. Cl.[2] ..... E04B 1/16
[52] U.S. Cl. ..... 264/35; 106/97; 106/98; 264/36; 264/133; 264/135; 264/256
[58] Field of Search ..... 264/36, 135, 256, 35, 264/133; 106/69, 97, 98

[56] References Cited

U.S. PATENT DOCUMENTS 2,768,563 10/1956 Immerman ..... 264/36 X

OTHER PUBLICATIONS

Reprint From California Highways and Public Works, Sep.-Oct. 1956, pp. 1-3.

*Primary Examiner*—Thomas P. Pavelko
*Attorney, Agent, or Firm*—Richard R. Mybeck

[57] ABSTRACT

A masonry method uniquely adapted for repairing structures constructed of adobe members whereby the broken or eroded portion of disfigured members is removed from the structure to create a void and expose an interface, the interface is cleaned, the cleaned interface is painted with a coating composition; the void is packed with a filling which intimately engages said coated interface and extends therefrom in a mass which is shaped to recreate the contour of the original adobe member; and the shaped mass is painted with said coating composition and allowed to cure. The coating composition comprises a modified acetate homopolymer formed in an emulsion having between 55.0 and 57.0 percent total solids, a mean particle size of 5 microns, a viscosity of between 500-1000 Cps, a pH of from 5.5 to 7.0 and diluted with an equal volume of water. The filling composition contains preselected portions of Portland cement, finely screened washed sand and a preselected amount of adobe dust mixed in water to create a plastic mixture having a trowelling consistency.

3 Claims, No Drawings

METHOD OF REPAIRING ADOBE MASONRY

This invention relates to methods and compositions for repairing structures formed of masonry and more particularly to methods and compositions uniquely adapted to the repair of structures formed from adobe members when the adobe members become deteriorated, damaged, broken or chipped.

Adobe, as used herein, refers to those structural members which are formed as a sun dried unburned brick of clay and straw or as a burned brick of clay. Still very popular in the Southwestern United States, adobe structures blend naturally into a desert terrain and many still stand which were erected several decades ago.

However, nothing is eternal, including adobe construction. Consequently, the ravages of wind, rain and intense sun can cause adobe to weather and deteriorate, and carelessness and vandalism has caused adobes to chip and break. Whatever the cause, it is necessary or desirable from time to time to repair such structures in order to restore their original beauty and integrity.

Heretofore, the only method known to the trade for the restoration of damaged adobe structures comprised removing the entire damaged brick member and its surrounding mortar to a depth of about 3½ inches using simply a hammer and chisel. After the faulty brick was removed, and in practice usually more than one required removal because the extraction inevitably resulted in one or more adjacent brick being damaged by an errant chisel placement or stray hammer blow, the rectangular opening was spread with mortar, a new half adobe brick was forced into the mortar, and the mortar lines were filled to conform with the existing structure.

The prior art method, as is readily apparent from the foregoing, was tedious, time consuming and often provided less than satisfactory color match whereby the repair was readily apparent to even a casual observer and contributed to the discredation of the long lasting aura surrounding adobe construction.

The present invention is predicated upon the discovery of simple and inexpensive methods and compositions for repairing worn, cracked or chipped adobe brick in situ without removing undamaged portions of the brick and without creating a visual demarcation between "old" and "new" adobe members.

Accordingly, it is a prime object of the present invention to provide improved methods and compositions for repairing adobe structures which substantially obviates all of the disadvantages inherent in the prior art method.

A still further object of the present invention is to provide new and improved methods and compositions for repairing adobe structures whereby worn, cracked, chipped or broken adobe brick are easily, quickly, and economically restored to their original shape and size.

Another object of the present invention is to provide improved methods and compositions for repairing adobe brick which allows substantially precise color matching whereby the repaired portion of an adobe brick is substantially undistinguishable colorwise from the remainder of the original member undergoing repair.

These and still further objects of the present invention as shall hereinafter appear are fulfilled by the present invention in a remarkably unexpected fashion as shall be readily discerned from the following detailed description of an exemplary embodiment of this invention.

In one practice of the present invention, an adobe structure in which one or more adobe bricks have been eroded, broken, chipped or otherwise damaged is repaired in the following fashion.

The broken piece or pieces of the adobe brick are removed and the surface exposed thereby is brushed, as with a wire brush, to eliminate loose particles. Next, the brushed surface is painted with a coating composition, hereinafter more fully described, and before the coating sets up, that is, while it is still tacky, I fill the missing portion of the brick with my patching or filling material. With a suitable implement, although a duckbill trowel is preferred, I shape the filling material to recreate the poly hydron, usually hexahydron, configuration of the original brick member.

As will appear hereafter, the filling material has a firm consistency but can slump slightly. If slump occurs, the desired shape is quickly restored by a few deft strokes of the trowel and thereafter, I coat the patch and the adjacent portion of the repaired brick with a thin uniform layer of the same coating composition used to prepare the patch bed.

When the final coat dries, a uniform adobe member exists where before it was damaged and is essentially undistinguishable from the rest of the surrounding adobe structure.

The coating composition herein described comprises a 1:1 water mixture with a modified acetate homopolymer emulsion characterized as having 55.0–57.0 percent total solids, a mean particle size of 5 microns, a pH of 5.5–7.0, viscosity of 500–1000 Cps and a mean weight of 9.2 pounds per gallon. Before mixture with water as indicated, the acetate appears as a milky white emulsion. "Modified acetate homopolymer" as used herein means a polyvinyl acetate homopolymer mixed with 5–10% (by weight) of a plasticizer selected from the group consisting of dibutyl phthalate, butyl benzyl phthalate, diamyl phthalate, dipropyl phthalate and like plasticizers which are known to be compatible with polyvinyl acetate homopolymer. If it is desired to practice the invention in the presence of freezing ambient temperatures a freeze-thaw stabilizer selected from the group consisting of propylene glycol, ethylene glycol, butyl cellosolve acetate or the like may be blended into the emulsion. To practice my invention in the arid portions of Arizona, Texas, New Mexico and California, where most traditional adobe structures now stand, a freeze-thaw stabilizer is not needed. In preparing of the patch base for receiving the original coating, it is necessary to clean the interface completely. As indicated, thorough wire brushing will usually do the job.

When it becomes apparent that extraordinary contaminants are present, other masonry cleaning techniques may be employed, all of which are within the normal skills of a practicing mason. Thus, it may be desirable to flush the surface with a jet water stream followed by an application of a suitable degreaser such as sodium metasilicate which, as is known, will absorb oils, fats and greases from concrete. After setting for about an hour or so, a water flush will clear the residue and place the surface in condition for the practice of the present invention.

The patching or filling composition herein described consists of two parts (by volume) of Portland cement, three parts (by volume) of washed sand which is then sifted through a standard window screen having openings of approximately one-sixteenth of an inch, and from about two to about four parts (by volume) of adobe dust, a term of my creation hereinafter defined. The window screen sieve which I used with my sand (approximately equivalent to a 10 mesh screen) allowed particles of about 1800 microns or smaller to pass through. While restraining the larger particles which I discarded, the volume measure which I used was a conventional water pair which I fill up to the line although any common container, even a tablespoon, may be used.

After I blend the dry constituents of my patching composition, I add a controlled amount of water to the blended materials until I obtain a uniform plastic mass of trowelling consistency.

"Adobe dust" as used herein referred to is a fine powder that I make by grinding an accumulation of broken adobes which I obtain from local lumber yards. I accumulate the fines in a large barrel and use what I need when I need it. A small ball mill or other known devices for grinding and pulverizing are equally suitable to make adobe dust.

The variation in the amount of adobe dust which I add to my filling composition is in part controlled by the intensity of adobe I desire in my patch. Thus, repair of a relatively new structure will require a different amount of an older structure because of the effect the longer exposure to the elements.

To further aid in the understanding of the present invention and not by the way of limitation, the following examples are presented.

EXAMPLE I

A modified acetate homopolymer emulsion having 55.0–57.0 percent total solids, a mean particle size of 5 microns, a pH of 5.5–7.0, a viscosity of 500–1000 Cps and a weight of 9.2 pounds per gallon is thoroughly administered with an equal volume of water to provide a coating composition for use in the practice of this invention.

EXAMPLE II

Two buckets Portland cement (as defined in Civil Engineer's Handbook) is mixed with three buckets of washed sand (particle size of about 1800 microns or less) and three buckets of adobe dust. The dry mixture is then blended into sufficient water to provide a mixture having good trowelling consistency. The material is ready for use as a patching composition in the practice of the present invention to repair medium color adobe.

EXAMPLE III

The procedure of Example II was repeated using two buckets of adobe dust to obtain a composition to repair lighter colored adobe.

EXAMPLE IV

The procedure of Example II was repeated using four buckets of adobe dust to obtain a composition to repair darker colored adobe.

From the foregoing description and examples it becomes apparent that the invention described fulfills all of the aforestated objectives in a remarkably unexpected fashion. It is, of course, understood that such modifications, applications and alterations as will readily occur to an artisan having the ordinary skills in the art of masonry are intended within the spirit of the present invention which is limited only by the scope of the claims appended hereto.

Accordingly, what I claim is:

1. The method of repairing adobe members having a deteriorated, broken or chipped portion and a body portion comprising: removing any residual broken or chipped pieces of the chipped portion to expose a surface of said body portion; cleaning said exposed surface; coating said cleaned exposed surface with a coating composition formed of a modified acetate homopolymer and water; filling said chipped portion with a patching composition of trowelling consistency formed from an admixture of water, Portland cement, washed sand and sufficient adobe dust to match the color of said body portion; shaping the filling composition to conform to the shape or the original adobe member; and coating the shaped filling with said coating composition.

2. A method according to claim 1 in which said coating composition consists of a 1:1 mixture of water and a modified acetate homopolymer emulsion, said emulsion characterized by 55.0–57.0 percent total solids, a mean particle size of 5 microns, a pH of 5.5–7.0, a viscosity of 500–1000 Cps and a mean weight of 9.2 pounds per gallon.

3. A method according to claim 1 in which said patching composition consists of two parts (by volume) of Portland cement, three parts (by volume) of screened washed sand of 1800 micorns or less, and from two to four parts (by volume) of adobe dust.

* * * * *